US006131584A

United States Patent [19]

Lauterbach

[11] Patent Number: 6,131,584

[45] Date of Patent: Oct. 17, 2000

[54] TOBACCO TREATMENT PROCESS

[75] Inventor: John H. Lauterbach, Macon, Ga.

[73] Assignee: Brown & Williamson Tobacco Corporation, Louisville, Ky.

[21] Appl. No.: 09/292,243

[22] Filed: Apr. 15, 1999

[51] Int. Cl.[7] ..... A24B 15/24; A24B 3/10; A24B 1/02

[52] U.S. Cl. ..... 131/297; 131/290; 131/300

[58] Field of Search ..... 131/290, 297, 131/300

[56] References Cited

U.S. PATENT DOCUMENTS

| | | | |
|---|---|---|---|
| 1,016,450 | 2/1912 | Smith . | |
| 1,813,833 | 7/1931 | Andrews . | |
| 2,783,760 | 3/1957 | Smith . | |
| 3,870,053 | 3/1975 | Heitkamp et al. . | |
| 4,244,381 | 1/1981 | Lendray . | |
| 4,566,468 | 1/1986 | Sachleben et al. | 131/297 |
| 4,605,016 | 8/1986 | Soga et al. . | |
| 4,727,889 | 3/1988 | Ninen, Jr. et al. . | |
| 4,898,189 | 2/1990 | Wochnowski . | |
| 5,005,593 | 4/1991 | Fagg . | |
| 5,025,812 | 6/1991 | Fagg et al. | 131/297 |
| 5,060,669 | 10/1991 | White et al. . | |
| 5,121,757 | 6/1992 | White et al. . | |
| 5,230,354 | 7/1993 | Smith et al. . | |
| 5,343,879 | 9/1994 | Teague . | |

*Primary Examiner*—James Derrington
*Assistant Examiner*—Dionne A. Walls
*Attorney, Agent, or Firm*—Charles G. Lamb; Middleton & Reutlinger

[57] ABSTRACT

Two types of tobacco are placed into and kept separate in an aqueous medium wherein water-soluble chemical components of each of the two types of tobacco are solubilized to form a tobacco extract. The two types of tobacco remain in the aqueous medium or tobacco extract until an equilibrium is reached of the solubilized chemical components in the aqueous medium. The two types of tobacco are then removed from the tobacco extract, dried separately, blended into a preselected ratio and cut into a preselected size for use in a cigarette smoking article. The tobacco extract may be subjected to other treatments to reduce the concentration of microflora and may be added back to the two types of tobacco prior to blending and cutting.

7 Claims, 1 Drawing Sheet

TOBACCO TREATMENT PROCESS

BACKGROUND OF THE INVENTION

This invention relates to an extraction of chemical components from one type of tobacco and transferring the extracted chemical components to another type of tobacco and more particularly relates to a process for making an additive-free tobacco feed material for cigarettes.

It is generally accepted practice in the manufacture of smoking articles that smoking articles are prepared from a blend of several different types of tobaccos, such as, for example, burley, flue-cured, and oriental tobaccos. Moreover, it is common to include additives with the tobacco blends to alter the taste characteristics of the tobacco. These include, for example, sugars, flavorings, and the like. However, in recent years it has been a goal in the cigarette industry to make additive-free or nearly additive-free cigarette products. Reaching this goal has created a number of problems for the industry.

SUMMARY OF THE INVENTION

It is an object of the present invention to provide a process for making an additive-free tobacco blend during the manufacturing of a smoking article.

It is another object of the present invention to provide a process for extracting chemical components from one type of tobacco and transfer the extracted chemical components to another type of tobacco for use in a tobacco blend for a cigarette.

Flue-cured tobaccos are known to be relatively high in water-soluble sugars. Burley tobaccos, after typical air curing, are known to be deficient in sugars. However, the air-cured burley tobaccos are known to be rich in ammonia and other water-soluble nitrogen-containing compounds. By translocating these water-soluble compounds from the burley tobacco to the flue-cured tobacco and vice versa, the preparation of blends of tobacco with improved sensory properties on smoking may be achieved without the use of additives such as generally used in making smoking tobaccos.

More particularly, the present invention is directed to a process for extracting chemical components from one type of tobacco and transferring the extracted components to one or more other types of tobacco. The process comprises the steps of subjecting two or more types of tobaccos to an aqueous suspension, the tobaccos being kept separate and the aqueous suspension being allowed time to dissolve the water-soluble components in each type of tobacco and equilibrate in concentration of dissolved components so that each type of tobacco is encased with an aqueous solution containing the same concentrations of chemical components which have been removed from the two types of tobaccos. Then, each type of tobacco and its surrounding aqueous solution is segregated from the other tobaccos and their corresponding aqueous solution. Each of the aqueous slurries of tobacco are then subjected to one or more concentration processes that reduce the moisture contents of the tobacco to a range suitable for cutting. Alternatively, each type of tobacco and its surrounding aqueous tobacco extract can be further segregated into extract and tobacco. The aqueous extract can then be concentrated and applied to the extracted tobacco as is or pre-dried such that the moisture content of the tobacco after reapplication of the extract is in a range suitable for cutting. The tobaccos treated by such process or processes are then blended in a preselected ratio and cut to a preselected size for use in cigarettes or other smoking articles. In order to reduce the growth of undesirable microflora in the damp tobacco and tobacco extract, tobaccos and extracts are subjected to treatments including pasteurization of the aqueous extract and/or tobacco slurry through ohmic heating and/or treatment of the extract and/or aqueous slurry with irradiation or with high intensity sound waves and/or high pressure and/or electromagnetic radiation. Preferably, control of microflora growth is carried out during the equilibration step. In the use of the term "equilibrium" or words synonymous therewith in this application, shall mean that the dissolution of the chemical components in the tobacco has reached a point that it is deemed not advantageous to continue further dissolution.

DETAILED DESCRIPTION OF THE PREFERRED EMBODIMENTS

Figure 1:
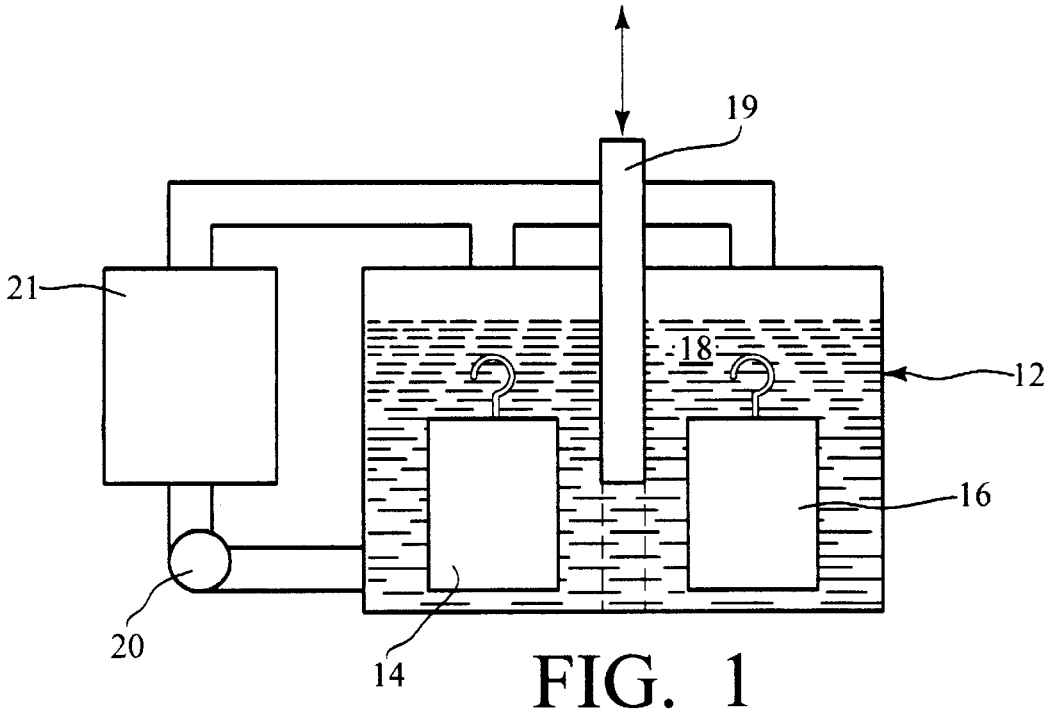
FIG. 1 is a schematic representation of one preferred lay-out for carrying out the equilibration of solubilizable components in two-types of tobacco; and, FIG. 2 is a flow diagram of a preferred process of the present invention.

As shown in FIG. 1, a container 12 is filled with water 18 to a level above two baskets filled with tobacco and identified by numerals 14 and 16. Container 12 also contains a barrier 19 that can be opened or closed as needed for equilibration of the solubilizable components in the tobaccos in baskets 14 and 16. For sake of illustration, basket 14 is generally filled with flue-cured tobacco and basket 16 is filled with burley tobacco. However, it is realized that other types of tobacco may be utilized such as oriental or the like without departing from the scope and spirit of the present invention. Likewise, if it is desired to apply the present invention to more than two types of tobacco at one time, container 12 would contain additional baskets and barriers such as 19.

When barrier 19 is opened the baskets 14 and 16 of tobacco are allowed to soak until the water has solubilized the water-soluble components within the tobaccos and reached an equilibrium of solubilized tobacco components within container 12. Heating and/or agitation may be used to reduce the time needed to reach equilibrium. For example, flue-cured tobacco in basket 14 will have a higher content of water-soluble sugars than burley tobacco in basket 16. Moreover, the burley tobacco in basket 16 will have higher levels of water-soluble ammonia and certain amino acids than the flue-cured tobacco in basket 14. Thus, during the equilibration, the water-soluble materials from the tobaccos in basket 14 and basket 16 reach an equilibrium and the tobaccos in baskets 14 and 16 are encased in a solution of chemical components of substantially the same concentrations.

A pump 20 may be provided to circulate the liquid in the container 12 which also decreases the time for equilibration of the soluble components. Pump 20 may also be used to remove the aqueous tobacco extract from the container 12, and circulate the extract to other processing equipment as noted by the numeral 21, for pasteurization or sterilization, or otherwise treat the aqueous extracts to reduce the concentration of microflora present in said extracts. Technologies that can be used to carry out such pasteurization, sterilization, or other reductions in microflora include ohmic heating, a high intensity electric field, ultrasound, ultra high pressure and/or electromagnetic radiation wherein equipment to carry out such processing steps are well known.

Such treatments can be applied intermittently or continuously depending on the degree of reduction in microflora desired. Alternatively, equipment employing the aforementioned technologies, with the exception of ultra high pressure can usually be placed in container 12.

Figure 2:
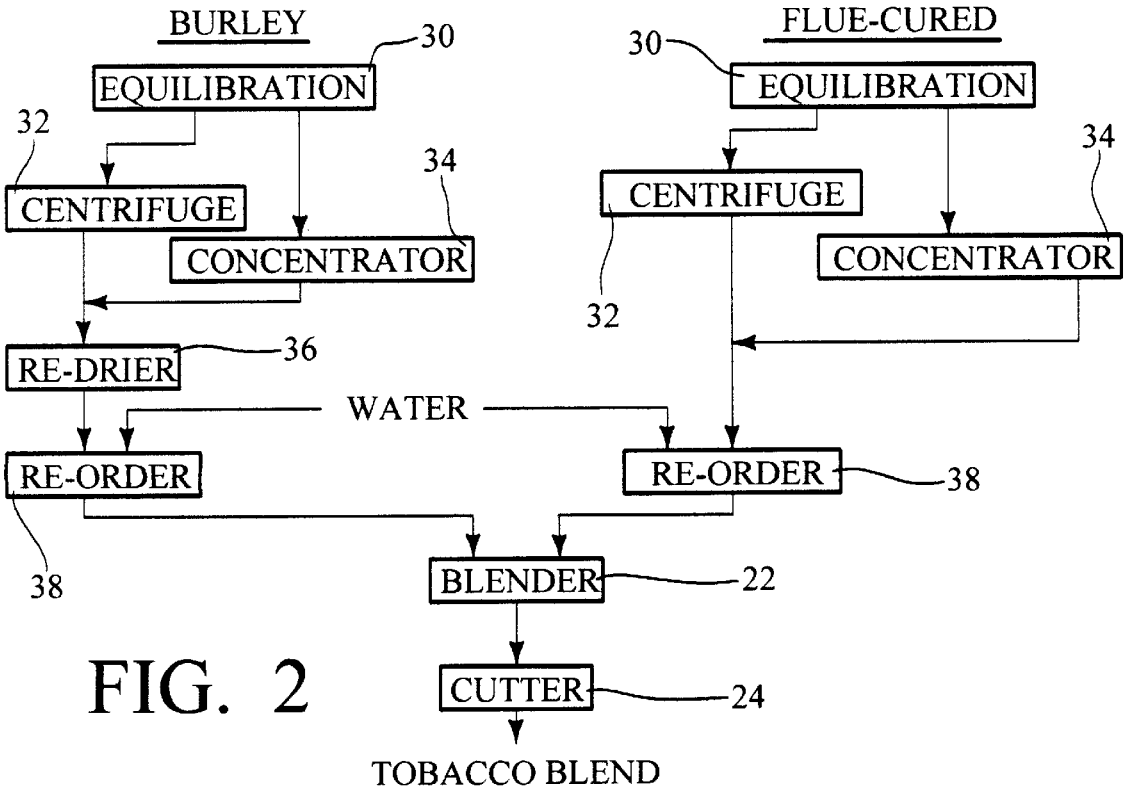

As set forth in FIG. 2, when equilibrium, as noted by the numeral 30, has been reached among the components in container 12 or at shorter or longer times as desired, the barrier 19 is closed. The tobacco in basket 14 and its surrounding aqueous extract are removed from container 12, and the tobacco and/or the extract are treated such that the moisture content of the mixture of tobacco and extract is in the range suitable for cutting, usually from about 21% to 25% by weight. For example, in the processing of burley tobacco in basket 16, after the equilibration step, the wet tobacco is transferred to a centrifuging step 32 where the moisture is reduced to a preselected moisture content. Tobacco extract is subjected to an evaporator or other means to increase the weight per cent of solubilized components as noted by the numeral 34. Tobacco extract from the concentrator step 34 is then added back to the burley tobacco and further drying is provided with a tobacco re-drier 36. The re-dried tobacco with the concentrated tobacco extract thereon usually has a moisture content less than the 21% to 25% moisture desired. Thus, the tobacco from the tobacco re-dried is fed to a re-ordering cylinder 38 wherein water is added to bring the tobacco to the desired moisture level for cutting. As for the flue-cured tobacco in basket 14, a similar process is carried out except the flue-cured tobacco is usually not subjected to a re-drier 36. After the drying and reordering of the encased tobaccos, a selected amount of each of the flue-cured and burley tobaccos is then fed into a commercially available tobacco blender 22 wherein the flue-cured tobacco and the burley tobacco are blended to a preselected ratio. From the blender 22, the blended tobacco is then fed into a tobacco cutter 24 wherein the blended tobacco is then cut to a preselected size for making a smoking article, such as a cigarette. The cut tobaccos are then dried to a moisture content appropriate for storage and/or packaging and/or fabrication into cigarettes or other smoking articles.

It will be realized that various other changes may be made to the specific embodiment shown and described which are obvious to those skilled in the art without departing from the principal and spirit of the present invention.

What is claimed is:

1. A process for treating tobacco comprising the steps of:

(a) placing a first type of tobacco and a second type of tobacco into a container filled with an aqueous medium, keeping said first and second types of tobacco separate therefrom in said aqueous medium;

(b) allowing the aqueous medium to dissolve water-soluble chemical components of each of the first and second types of tobacco simultaneously and, (c) bringing the aqueous medium to an equilibrium of the water-soluble components of the first and second types of tobacco with the resulting aqueous medium being a tobacco extract.

2. The process of claim 1 wherein said first type of tobacco is a flue-cured tobacco and said second type of tobacco is burley tobacco.

3. The process of claim 1 including the additional steps of:

(d) removing the first and second types of tobacco from said aqueous medium and bringing said first and said second types of tobacco to a preselected moisture content;

(e) blending said first and said second types of tobacco at a preselected ratio; and, (f) cutting said blended tobaccos to a preselected size.

4. The process of claim 3 including the step of treating the tobacco extract to reduce the concentration of microflora.

5. The process of claim 4 wherein said treating tobacco extract is carried out during the step of bringing the aqueous medium to an equilibrium.

6. The process of claim 4 wherein treating tobacco extract is carried out by subjecting said tobacco extract to one or more treatments including a high intensity electric field, ultrasound, ultra high pressure, or electromagnetic radiation.

7. The process of claim 1 wherein the tobacco extract, after the step of bringing the aqueous medium to an equilibrium, is subjected to a step of increasing the concentration of water soluble chemical components then adding the tobacco extract to at least one of the first or second types of tobacco prior to blending.

* * * * *